US006367750B1

(12) United States Patent
Ford

(10) Patent No.: US 6,367,750 B1
(45) Date of Patent: Apr. 9, 2002

(54) PORTABLE SIGN HOLDING APPARATUS

(76) Inventor: Gary Drew Ford, 778 Garrett Rd., Upper Darby, PA (US) 19082

( * ) Notice: Subject to any disclaimer, the term of this patent is extended or adjusted under 35 U.S.C. 154(b) by 0 days.

(21) Appl. No.: 09/455,219

(22) Filed: Dec. 6, 1999

Related U.S. Application Data

(63) Continuation-in-part of application No. 09/141,292, filed on Aug. 27, 1998, now abandoned.

(51) Int. Cl.[7] ..... A47F 5/00; E06B 7/28

(52) U.S. Cl. ..... 248/208; 248/200.1; 40/606; 40/617

(58) Field of Search ..... 40/606, 607, 610, 40/617; 248/208, 287.1, 124.1, 200.1, 317; 182/11, 142

(56) References Cited

U.S. PATENT DOCUMENTS

| | | | | | |
|---|---|---|---|---|---|
| 339,871 | A | * | 4/1886 | Pogarty | 248/208 |
| 1,275,053 | A | * | 8/1918 | Leiding | 248/208 |
| D69,991 | S | * | 4/1926 | Fullerton | D20/42 |
| 2,902,241 | A | | 9/1959 | Spitko | 248/208 |
| 2,903,227 | A | | 9/1959 | Key | 248/200.1 |
| 3,025,389 | A | | 3/1962 | Esch | 362/147 |
| 3,115,322 | A | * | 12/1963 | Fleming | 248/200.1 |
| 3,225,818 | A | | 12/1965 | Wise | 160/24 |
| 3,541,322 | A | | 11/1970 | Bennett | 362/121 |
| 4,219,179 | A | | 8/1980 | Silbernagel | 248/488 |
| 5,094,023 | A | * | 3/1992 | McVey | 40/606 |
| 5,617,963 | A | * | 4/1997 | Baziuk et al. | 248/208 |
| 5,685,104 | A | * | 11/1997 | Breazeale, Jr. | 248/287.1 |

* cited by examiner

*Primary Examiner*—Anita King
*Assistant Examiner*—Gwendolyn Baxter
(74) *Attorney, Agent, or Firm*—Massinger Law Office

(57) ABSTRACT

A portable sign holding apparatus for use in single and double-hung windows generally comprising a central housing unit which includes horizontal mounting means for engaging the interior of window jambs, vertical mounting means for engaging the window sill and sash, and sign support means capable of suspending a sign in perpendicular relationship to the face of a building. In use, the horizontal and vertical mounting means engage the surfaces of windows of different sizes via telescopic adjustability to prevent lateral and vertical movement of the apparatus, respectively, within the window frame. Movement of the apparatus and support of the weight of the sign are further provided by a bracket disposed between the sign support means and the exterior wall surface of the building. In combination, the bracket, and vertical and horizontal mounting means provide a highly stable sign suspension device which may be quickly and easily installed without any screws or other invasive means. The subject device is collapsible for transport and storage.

5 Claims, 3 Drawing Sheets

PORTABLE SIGN HOLDING APPARATUS

CROSS REFERENCE TO RELATED APPLICATIONS

This is a continuation-in-part of U.S. patent application Ser. No. 09/141,292 filed Aug. 27, 1998 abandoned, entitled Portable Window Sign Kit.

FIELD OF THE INVENTION

The subject invention relates to sign holding devices in general, and to one such device with characteristic portability and non-invasive installation capability, in particular.

BACKGROUND OF THE INVENTION

The use of signs with various indicia thereon is a well-known means of communication of information to the general public. In real estate, for example, it is common to use signs for purposes of communicating that a property is for sale or rent. Typically, such signs will be suspended from or fixedly mounted to frame members which are implanted into the ground of the property. Often times, however, there is no ground available for this purpose. Particularly in urban settings where only sidewalks exist between street curbs and the building itself, conventional means of fixing signs to the property are impossible or impractical. In such situations, it is common for realtors to place their signs within the interior of windows such that they are coplanar with the glass of the window and visible from passers by. This practice has a significant shortcoming, namely that signs cannot be mounted perpendicular to the face of the building front and therefore cannot be as readily viewed from passing motorists and pedestrians.

It is, therefore, a primary object of the subject invention to provide a sign holding apparatus which may be readily and easily installed within window frames of dwellings without the use of tools.

It is another primary object of the invention to provide a sign holding apparatus which may be passively and removably installed within window frames of dwellings without the need for invasive securing means such as screws and the like.

It is a further primary object of the subject invention to provide a portable sign holding device capable of supporting signs when installed without damage to the surrounding window frames and which is further capable of resisting undesired movement which may otherwise be caused by the weight of the sign, gravitational forces and/or the wind.

It is another primary object of the present invention to provide a sign holding apparatus capable of both longitudinal and vertical adjustment such that the device may be installed in windows of various sizes.

Still another important object of the present invention is to provide a sign holding apparatus which, when installed, displays signs in perpendicular relationship to the face of the dwelling such that indicia on the signs may be more readily viewed by persons approaching the building from either side.

Yet another important object of the present invention is to provide a sign holding apparatus which is lightweight and collapsible to facilitate transport and storage thereof.

Other important characteristics of the subject invention are that it is inexpensive and simple to manufacture from readily available parts, and is fabricated of materials which are weather resistant and require little maintenance.

These together with other objects and advantages of the invention, along with the various features of novelty which characterize the invention, are pointed out with particularity in the claims annexed to and forming a part of this disclosure. For a better understanding of the invention, its advantages and the specific objects attained by its uses, reference should be made to the following summary, drawings and detailed description of the invention.

SUMMARY OF THE INVENTION

The subject invention accomplishes the above recited objects through the provision of a portable sign holding apparatus generally comprising a central housing unit which includes horizontal mounting means for engaging the interior of window jambs, vertical mounting means for engaging the window sill and sash, and sign support means capable of suspending a sign in perpendicular relationship to the face of a building. In use, the horizontal and vertical mounting means engage the surfaces of windows of different sizes though telescopic adjustability and further prevent lateral and vertical movement of the apparatus, respectively, within the window frame.

The subject sign holding device is predominantly used in association with single and double-hung type windows whereby the horizontal mounting means portion of the central housing lays situate underneath the lower window which is opened slightly to accommodate its presence. Once the horizontal mounting means are set to engage the window jams, the lower window is lowered on top of the mounting means such that the weight of the window will assist in preventing movement of the cantilevered sign support means. A bracket is disposed diagonally between the sign support means and the face of the building to further encourage stability of the device. Movement is still further prevented through the vertical mounting means which are adapted to forcibly engage the bottom surface of the upper window such that the central housing unit is further biased against the window sill. In combination, the bracket, and vertical and horizontal mounting means provide a highly stable sign suspension device which may be quickly and easily installed and removed.

Other features of the subject sign support apparatus include a plurality of sign retention means which may be positioned at an infinite number of locations along the length of the sign support means to accommodate signs of various size. An optional electric receptacle may also be housed within the subject invention to receive plugs from lighting fixtures which may also be mounted to the sign support means to illuminate the sign suspended therefrom.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE PREFERRED EMBODIMENT

Figure 1:
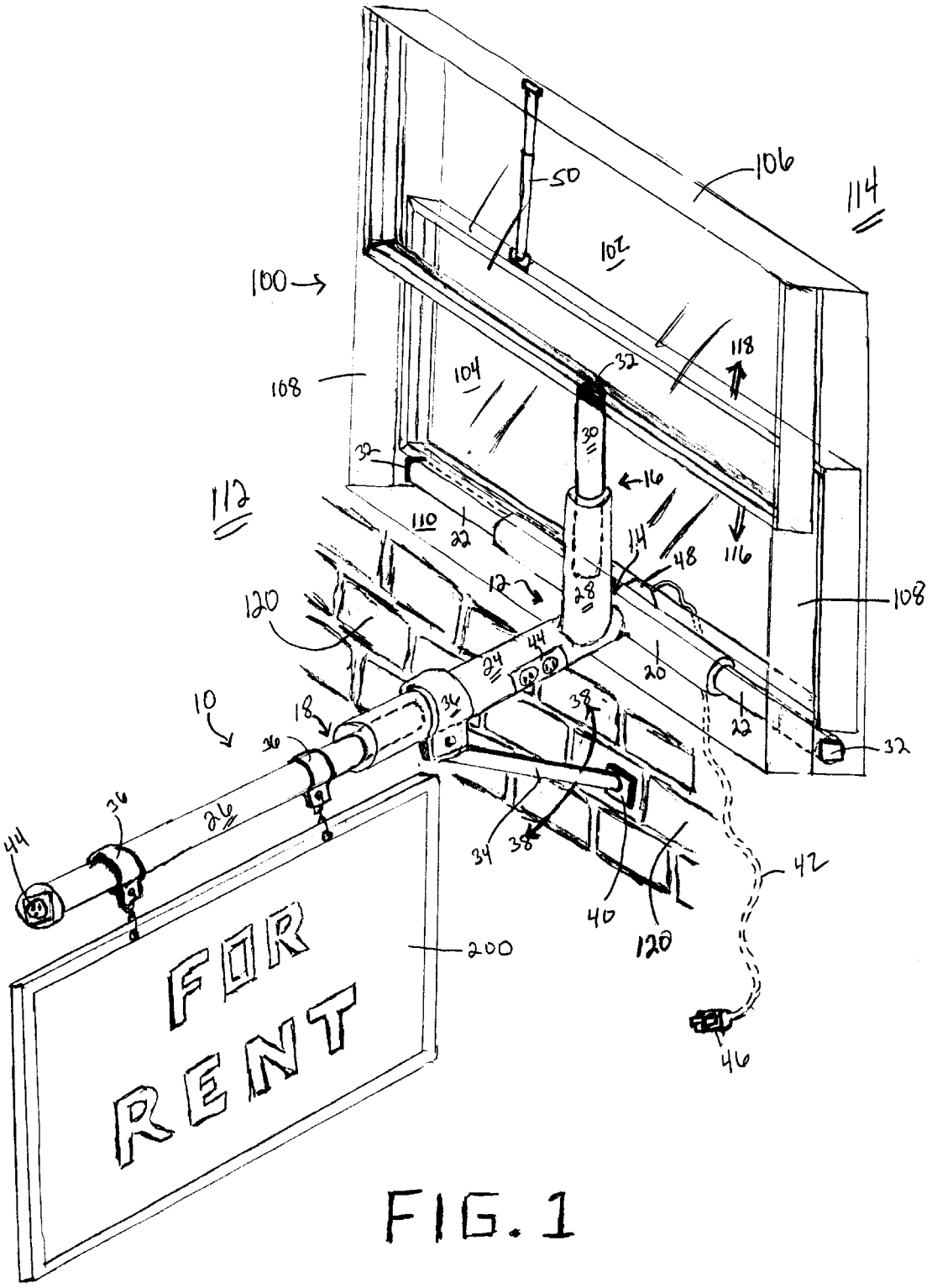
FIG. 1 is a perspective view of the subject sign holding apparatus as installed in a conventional double hung window.

Reference is now made to FIG. 1 in which there is illustrated a perspective view of the preferred embodiment of the subject sign holding apparatus designated generally by reference numeral 10 as installed in a conventional double hung window which in turn is designated generally by reference 100. It should be appreciated at the outset that window assembly 100 does not form a part of the subject invention but rather serves as the site of the subject invention's installation and use. For purposes of better understanding how the subject sign support apparatus is installed and functions, the anatomy of window assembly 100 will first be briefly described.

Window assembly 100 is preferably of the single or double hung variety. The subject invention is not suited nor intended to be appropriate for installation in casement-type windows. Window assembly 100 is comprised of top window 102 and bottom window 104, each of which are slidably received within window frame 106 which in turn is comprised of jams 108 and sill 110. As with most conventional double hung windows, top window 102 is in closer proximity to the outside 112 of the dwelling and bottom window 104 is closer to the inside of 114 of the dwelling. In use, top window 102 is capable of sliding down towards and in engagement with sill 110 as indicated by directional arrow 116. Bottom window 104 is similarly capable of vertical movement as indicated by directional arrow 118.

With continued reference to FIG. 1, the subject sign holding apparatus is generally comprised of a central housing unit 12 which includes horizontal mounting means 14, vertical mounting means 16 and sign support means 18. Horizontal mounting means 14 are comprised of horizontal receiving tube 20 which is hollow and open on each end to slidably receive therein lateral extension arms 22. As may be readily appreciated, lateral extension arms 22 are capable of telescopic extension such that the overall length of horizontal mounting means 14 is capable of significant adjustment to accommodate windows of varying size.

Sign support means 18 is comprised of sign support tube 24, the proximal end of which is in fixed communication with the midpoint of horizontal receiving tube 20 and extends perpendicularly therefrom. Sign support tube 24 is also hollow and open at its distal end to slidably receive sign support arm 26 again in telescopic fashion. Sign support arm 26 is also hollow and capable of receiving another extension arm (not shown) if an increase in the overall length of sign support means 18 is desirable. It should be noted that when subject sign holding apparatus 10 is properly installed, horizontal mounting means 14, sign support means 18 and window sill 110 all occupy the same horizontal plane.

Figure 2:
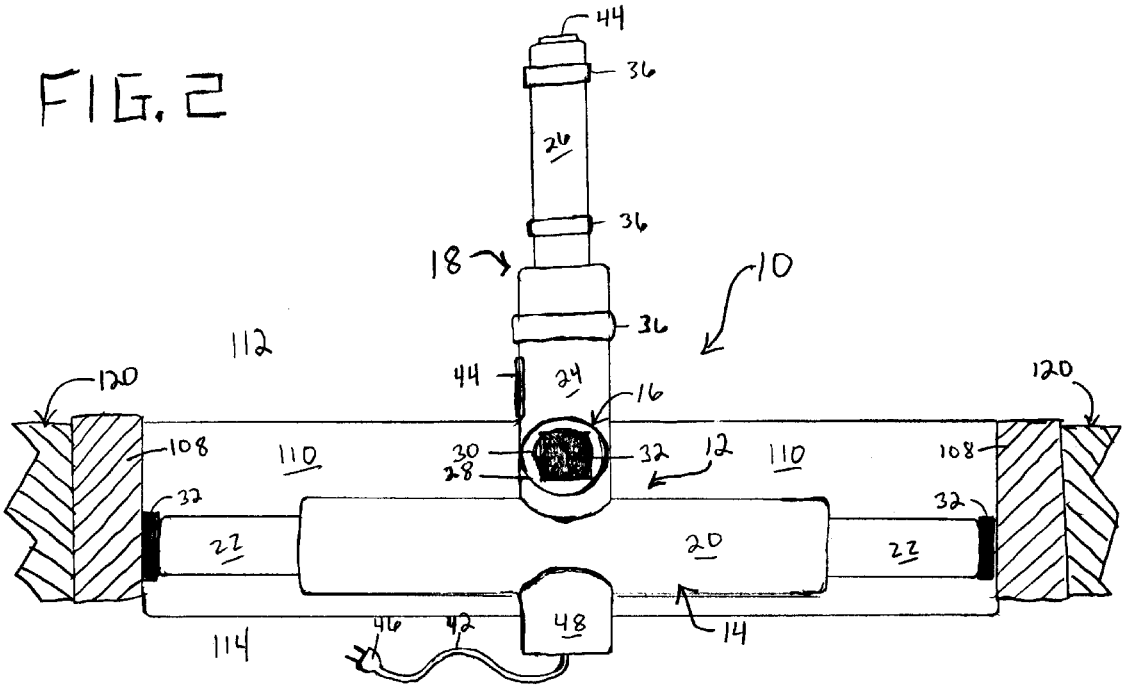
FIG. 2 is a plan view of the subject sign holding apparatus as installed in a conventional double hung window.
Figure 3:
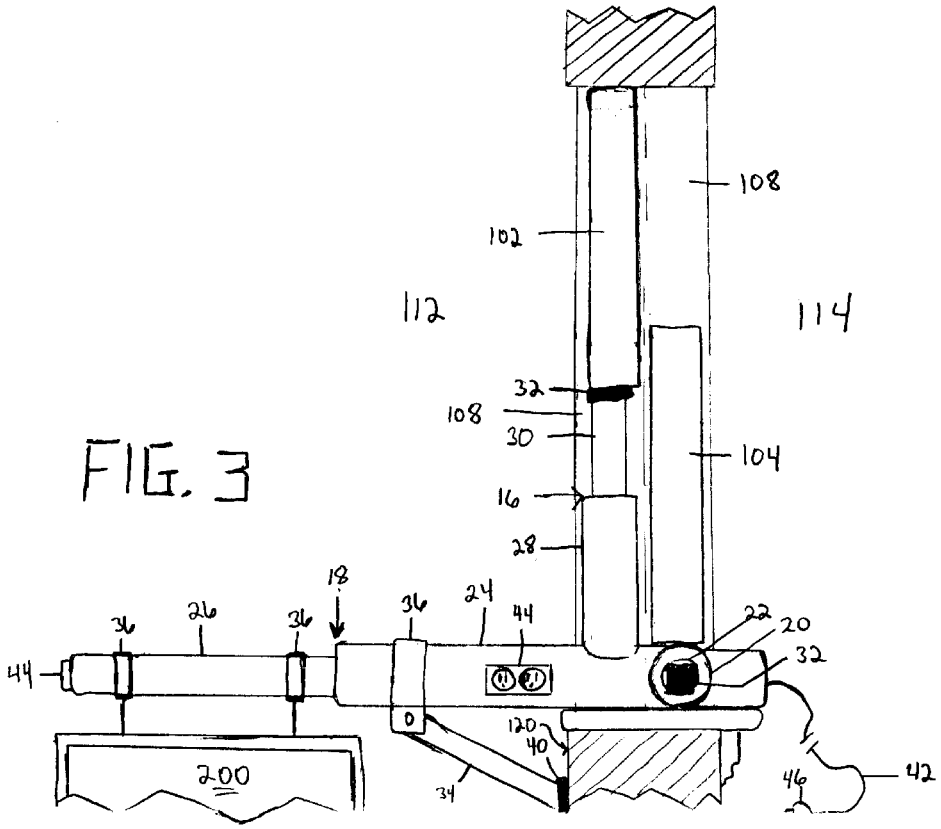
FIG. 3 is a side view of the subject sign holding apparatus as installed in a conventional double hung window.

Turning now to FIGS. 2 and 3, the orientation of vertical mounting means 16 may be observed with respect to the sign support means 18 from which it extends. More specifically, vertical mounting means 16 is comprised of vertical receiving tube 28 which is fixedly attached to and extends perpendicularly from sign support tube 24 of sign support means 18. Vertical mounting means 16 when properly installed will be vertically oriented and relatively coplanar with top and bottom windows 102 and 104. Vertical receiving tube 28 is hollow and open at its distal end to slidably receive therein vertical extension arm 30. In a manner similar to horizontal mounting means 14, the length of vertical mounting means 16 is capable of adjustment again to accommodate windows of different size. As best observed in FIG. 1, vertical extension arm 30 is intended to engage the bottom surface of top window 102 thereby biasing the central housing unit 12 against sill 110.

The terminal ends of lateral extension arms 22 and vertical extension arm 30 are adapted with end caps 32 which are preferably fabricated of a semi-ridged plastic or rubber material. It may further be observed that sign support tube 24 has mounted thereto one end of hinged bracket 34 via ring clamp 36. Bracket 34 is capable of pivotable movement along the vertical plane indicated by bracket directional arrows 38. The opposite end of bracket 34 is also equipped with a replaceable rubber stop plate 40.

With regard to materials of manufacture, most components of the subject sign holding apparatus 10 can be made of materials noted for their strength and light weight such as, for instance, aluminum or poly vinyl chloride. Such materials are also well-known for their ability to resist deterioration as a result of exposure to the elements. Central housing unit 12, horizontal mounting means 14, vertical mounting means 16 and sign support means 18 are all preferably manufactured from PVC materials which are readily available and tubular in design. While FIG. 1 depicts these components in round tubular form, it should be understood that the same telescopic properties could easily be achieved using components which are square or rectangular in cross section. In fact, it may be preferable for horizontal mounting means 14 to be of rectangular cross section such that the bottom surface of bottom window 104 can more completely engage the upper surface of horizontal mounting means 14 thereby creating a weather-proof seal.

Method of Installation

To install the subject apparatus, the device is first oriented such that signs support means 18 extends to the outside 112 of the dwelling. Installation of sign holding apparatus 10 will typically be accomplished from the inside 114 of the dwelling although installation from the outside 112 is also possible if the window is unlocked and if the window is accessible to the installer. The first step of the installation will be to fully open bottom window 104 in the upper direction as indicated by directional arrow 118. Again, the apparatus should be placed within window frame 106 such that sign support means 18 extends outside of the dwelling. The bottom of horizontal mounting means 14 should be caused to engage the surface of window sill 110 directly underneath bottom window 104. Thus positioned, lateral extension arms 22 should be slidably extended from horizontal receiving tube 20 until end caps 32 snugly engage the surface of jams 108. Extension arm retaining means (not shown) should be activated to tightly secure lateral extension arms 22 in place. Such retention means may include, for example, a convention chuck mechanism, locking pins or other clamping means which are well-known in the art. The object of the retention means is to prevent movement of lateral extension arms 22 within horizontal receiving tube 20 when the proper length has been received. When properly installed, horizontal mounting means 14 will be firmly biased between each window jam 108 thereby preventing movement of sign support means 18 along the horizontal plane.

In a manner similar to that previously described for the installation of horizontal mounting means 14, vertical extension arm 30 is extended from vertical receiving tube 28 until its end cap 32 lies in forcible engagement with the bottom surface of top window 102. Properly positioned and locked into place, vertical mounting means 16 will force the bottom surface of horizontal mounting means 14 and the bottom surface of the proximal end of sign support means 18 against the top surface of window sill 110. It is now appropriate to note that horizontal and vertical mounting means may further include springs housed within their respective receiving tubes to further encourage bias of their respective extensive arms against jams 108 and the bottom surface of top window 102.

It should be obvious that when sign 200 is suspended from sign support arm 26 as herein described, the resulting downward force may promote rotation and displacement of the sign holding apparatus 10 as a whole. To further prevent this occurrence, bracket 34 should be pivoted such that rubber stop plate 40 is caused to engage the exterior surface of wall 120. The weight of sign 200 will produce force sufficient to firmly maintain bracket 34 in this position. Additionally, the frictional forces associated with the union of rubber stop plate 40 to exterior wall 120 will further prevent movement of sign support means 18 and stabilize sign holding apparatus 10 generally.

Figure 4:
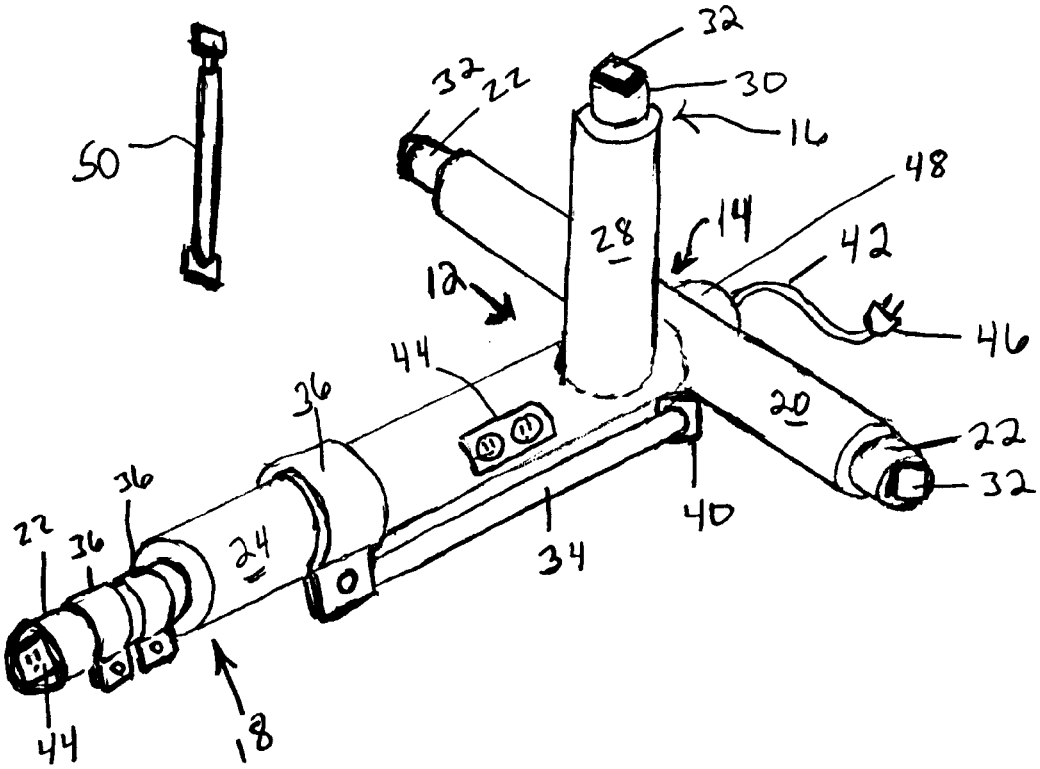
FIG. 4 is a perspective view of the subject sign holding apparatus folded into a compact configuration for transport and/or storage.

Sign 200 may be suspended from sign support arm 26 using conventional means. In this case, additional ring clamps 36 are illustrated and are preferred because they can be loosen to permit storage of sign support arm 26 within sign support tube 24 (as illustrated in FIG. 4). With reference now to FIGS. 1, 2 and 3, it may be observed that sign holding apparatus 10 can be equipped with an optional electric cord 42 to provide power to small lighting devices (not shown) which can be removably attached to sign support means 18 for purposes of illuminating sign 200 at night. Electric cord 42 is disposed through sign support means 18 such its receptacle end 44 is available for access on the surface of either sign support tube 24 or at the distal end of sign support arm 26 as shown. Those skilled in the art may quickly identify the most appropriate means of carrying out this function. The opposite end of electric cord 42 terminates in plug 46. As illustrated, the plug end of electric cord 42 emerges from portal 48 which emerges from horizontal receiving tube 20 opposite and in communication with sign support tube 24. Plug 46 may be plugged into any available interior receptacle to provide the necessary power.

Once sign holding apparatus 10 is installed as described above, bottom window 104 is lowered until its bottom surface engages the upper surface of horizontal mounting means 14. Optional weatherstripping may also be used to create a weatherproof seal if desired. As mentioned above, the weight of bottom window 104 will further stabilize sign holding apparatus 10 and prevent any unwanted movement. To complete installation of the subject device and prevent bottom window 104 from being opened by intruders, adjustable security bar 50 is installed as shown.

Referring now to FIG. 4, it may be readily observed that the subject apparatus is capable of being collapsed to a compact configuration for purposes of transport and storage. The portability and ease of installation of the subject apparatus makes it ideal for use by realtors. No tools are required for its installation nor are any screws or other damaging and invasive means required.

Although the present invention has been described with reference to the particular embodiments herein set forth, it is understood that the present disclosure has been made only by way of example and that numerous changes in details of construction may be resorted to without departing from the spirit and scope of the invention. Thus, the scope of the invention should not be limited by the foregoing specifications, but rather only by the scope of the claims appended hereto.

What is claimed as being new, useful and desired to be protected by Letters Patent of the United States is as follows:

1. A portable sign holding apparatus for use in combination with single or double hung type windows, the apparatus comprising:

a) horizontal mounting means;

b) sign support means one end of which is fixedly and perpendicularly mounted to said horizontal mounting means;

c) vertical mounting means one end of which is fixedly and perpendicularly mounted to said sign support means; and d) a bracket hingedly attached to said sign support means.

2. The portable sign holding apparatus of claim 1, wherein said vertical mounting means is situated above said sign support means and said bracket is situated below said sign support means.

3. A portable sign holding apparatus for use in combination with single or double hung type windows, the apparatus comprising:

a) horizontal mounting means comprised of first and second lateral extension arms and a horizontal receiving tube, said first and second lateral extension arms being telescopically received within and extending from the open ends of said horizontal receiving tube;

b) sign support means comprising a sign support arm and sign support tube, said sign support tube having proximal and distal ends, said sign support arm being telescopically received within and extending from said distal end of said sign support tube, said proximal end of said sign support tube being fixedly and perpendicularly mounted to said horizontal mounting means;

c) vertical mounting means comprising a vertical support arm and vertical support tube having proximal and distal ends, said proximal end of said sign support tube being fixedly and perpendicularly mounted to said sign support means; and d) a bracket hingedly attached to said sign support means.

4. The portable sign holding apparatus of claim 3, wherein said vertical mounting means is situated above said sign support means and said bracket is situated below said sign support means.

5. A method of hanging a sign from a single or double hung type window assembly, said method comprising the steps of:

a) positioning horizontal mounting means across a window sill of the window assembly;

b) biasing said horizontal mounting means between a jamb of a window frame of the window assembly;

c) suspending sign support means outside of the window, said sign support means having one end fixedly and perpendicularly mounted to said horizontal mounting means;

d) biasing vertical mounting means between the bottom surface of the top window of the window assembly and the window sill of the window assembly, said vertical mounting means having one end fixedly and perpendicularly mounted to said sign support means; and e) hanging the sign from said sign support means.

* * * * *